US007242139B2

(12) United States Patent
Hsu et al.

(10) Patent No.: US 7,242,139 B2
(45) Date of Patent: Jul. 10, 2007

(54) LUMINESCENCE BRIGHTNESS COMPENSATION STRUCTURE OF FIELD-EMISSION DISPLAY

(75) Inventors: Wei-Sheng Hsu, Guanyin Township, Taoyuan County (TW); Chi-Hung Hsiao, Guanyin Township, Taoyuan County (TW)

(73) Assignee: TECO Nanotech Co., Ltd., Taoyuan (TW)

( * ) Notice: Subject to any disclaimer, the term of this patent is extended or adjusted under 35 U.S.C. 154(b) by 242 days.

(21) Appl. No.: 10/934,579

(22) Filed: Sep. 3, 2004

(65) Prior Publication Data

US 2005/0231099 A1 Oct. 20, 2005

(30) Foreign Application Priority Data

Apr. 14, 2004 (TW) ..... 93110353 A

(51) Int. Cl.
*H01J 63/04* (2006.01)
*H01J 1/62* (2006.01)
*H01J 19/06* (2006.01)

(52) U.S. Cl. ..... 313/497; 313/495; 313/309; 313/346 R

(58) Field of Classification Search ..... 313/495, 313/497, 309, 346 R
See application file for complete search history.

(56) References Cited

U.S. PATENT DOCUMENTS

| | | | | |
|---|---|---|---|---|
| 3,697,301 | A * | 10/1972 | Donofrio et al. | 428/334 |
| 5,654,607 | A * | 8/1997 | Yamaguchi et al. | 313/495 |
| 5,952,776 | A * | 9/1999 | Van Doorn et al. | 313/461 |
| 6,049,165 | A * | 4/2000 | Spindt et al. | 313/495 |
| 6,747,416 | B2 * | 6/2004 | Barger et al. | 315/169.3 |
| 6,861,794 | B2 * | 3/2005 | Horne | 313/466 |
| 2001/0024680 | A1 * | 9/2001 | Horne | 427/68 |
| 2005/0225232 | A1 * | 10/2005 | Boroson et al. | 313/504 |
| 2005/0264169 | A1 * | 12/2005 | Lee | 313/496 |
| 2006/0138945 | A1 * | 6/2006 | Wolk et al. | 313/506 |

* cited by examiner

*Primary Examiner*—Joseph Williams
*Assistant Examiner*—Peter Macchiarolo

(57) ABSTRACT

A luminescent brightness compensation of sub-pixels of tri-electrode based field-emission display. The cathode conductive layers corresponding to sub-pixels constituting a pixel are arranged at various levels according to the respective luminescent efficiencies thereof. Thereby, the color with lower or higher luminescent efficiency obtains a stronger or weaker electric field between anode and cathode, respectively. Therefore, the different luminescent efficiency of three sub-pixels with primary color is compensated.

6 Claims, 2 Drawing Sheets

LUMINESCENCE BRIGHTNESS COMPENSATION STRUCTURE OF FIELD-EMISSION DISPLAY

BACKGROUND OF THE INVENTION

The present invention relates in general to a field-emission display, and more particularly, to compensation of luminescent brightness of sub-pixels of a field-emission display.

The field-emission display (FED) is a very newly developed technology. Being self-illuminant, such type of display does not require a back light source like the liquid crystal display (LCD). In addition to the better brightness, the viewable angle is broader, power consumption is lower, responding speed is faster (no residual image), and the operation temperature range is larger than currently available flat displays. The image quality of the field-emission display is similar to that of the conventional cathode ray tube (CRT) display, while the dimension of the field-emission display is much thinner and lighter than the cathode ray tube display. Therefore, it is foreseeable that the field-emission display will replace the liquid crystal display and plasma display panel in the future. Further, the fast growing nanotechnology enables nano-material to be applied in the field-emission display, such that the technology of field-emission display will be commercially available in the near future.

FIG. 1 shows a cross sectional view of a basic tri-electrode based field-emission display essentially consisting of an anode plate 10, a cathode plate 20 and a gate layer 25. The anode plate 10 and the cathode plate 20 are supported by a spacer 14. The anode plate 10 includes an anode substrate 11, an anode conductive layer 12 and a phosphor layer 13. The cathode plate 20 includes a cathode substrate 21, a cathode conductive layer 22, an electron-emission source layer 23 and a dielectric layer 24. The gate layer 25 is apart disposed between the anode plate 10 and the cathode plate 20. The anode plate 10 is subjected to a potential difference to drain electron beams emitted from the electron-emission source layer 23. The voltage provided by the gate layer 25 accelerates the electron beams to impinge the phosphor layer 13 of the anode plate 10, so as to generate visible light.

The display includes a plurality of pixels composed of red, blue and green cathode and anode units. One anode unit with one of the three primary colors can be called "sub-pixel". The different composition of the phosphor layer 13 provides three primary colors; however, the lights with different color emitted by the phosphors have different luminescent efficiencies. As a result, although the electron beams emitted from the electron-emission source layer carry the same kinetic energy, the brightness efficiencies of different colored phosphors are different. Thus, the brightness of the different colored lights emitted from the phosphor layer are substantially different. Typically, the brightness ratio of the red, blue and green colored light is about 2:1:7. Therefore, color or brightness distortion at one pixel or on whole screen always occurs. In order to solve this problem, conventional FEDs use a complex control circuit to compensate the inconsistent luminescent efficiencies. But this solution costs a lot. It is thus very uneconomic.

Another approach to resolve the discrepancies in luminescent efficiencies is to adjust the thickness or area size of the phosphor layer 13. The drawback of such approach is that it is very difficult to make the thickness or area size of the phosphor layer 13 for the same colored sub-pixels maintain the identicality among different pixels because of extremely numerous pixels in a display to be processed.

BRIEF SUMMARY OF THE INVENTION

A luminescent brightness compensating structure for a field-emission display is provided to allow the differences in luminescent efficiencies for three primary colors within each pixel of the display to be compensated under the same voltages provided between anode, cathode and gate electrode. In addition, the compensating structure does not require complex circuit or process, such that the cost is greatly reduced.

The luminescent brightness compensating structure includes a cathode conductive layer with different levels in height according to the luminescent efficiency of the different colored phosphor layer, such that the distance between the electron-emission layer of the cathode plate and the gate layer for three primary colors is adjusted to be different. As a result, different electric fields are driven for the cathode and anode units according to the color of the phosphor layer. Therefore, the discrepancies of luminescent efficiencies for different colors can be compensated.

BRIEF DESCRIPTION OF THE DRAWINGS

The above objects and advantages of the present invention will be become more apparent by describing in detail exemplary embodiments thereof with reference to the attached drawings in which.

DETAILED DESCRIPTION OF THE INVENTION

Figure 1:
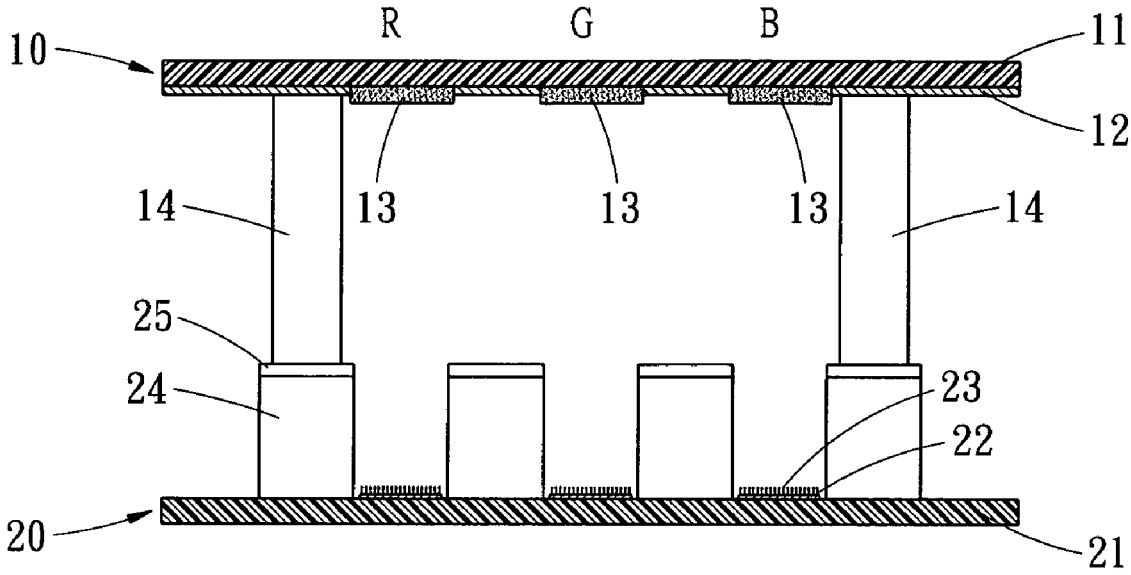
FIG. 1 PRIOR ART
FIG. 1 is a cross sectional view of a conventional tri-electrode based field-emission display.
Figure 2:
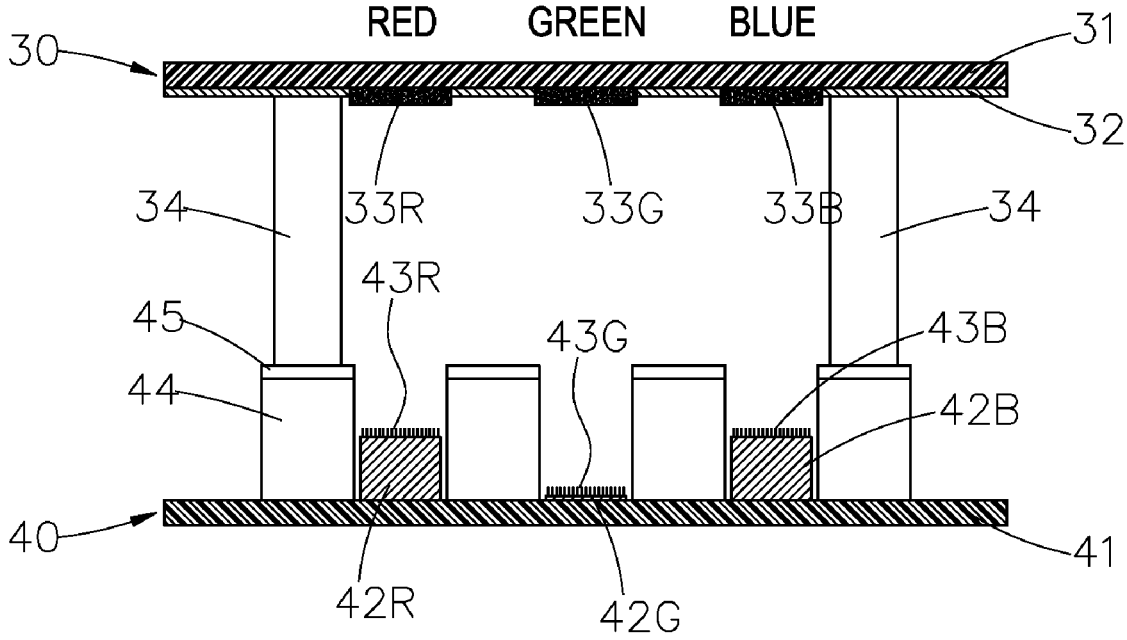
FIG. 2 is a cross sectional view of an embodiment of a tri-electrode based field-emission display according to the present invention.

Referring to FIG. 2, as provided, the field-emission display of a preferred embodiment according to the present invention is based on a tri-electrode topology, essentially including an anode plate 30, a cathode plate 40 and a gate layer 45 apart disposed between the anode plate 30 and the cathode plate 40. The anode plate 30 includes an anode substrate 31, an anode conductive layer 32 form on the anode substrate 31 and a phosphor layer 33 formed on the anode conductive layer 32. The phosphor layer 33 is composed of a plurality of red, green and blue anode units 33R, 33G, 33B. Each anode unit 33R, 33G, 33B forms a sub-pixel with one primary color. One red anode unit 33R, one green anode unit and one blue anode unit 33B constitute a pixel of the display. A spacer 43 is disposed between anode plate 30 and gate layer 45. The cathode plate 40 includes a cathode substrate 41, a cathode conductive layer 42 formed on the cathode substrate 41 and an electron-emission layer 43 formed on the cathode conductive layer 42, The electron-emission layer 43 is composed of a plurality of cathode units 43R, 43G, 43B. A dielectric layer 44 is disposed between gate layer 45 and cathode plate 40. As shown, each anode unit 33R, 33G, 33B is aligned with a cathode unit 43R, 43G, 43B.

A person skilled in the art must know that the luminescent efficiency ratio for the green, red and blue light emitted by the anode unit 33G, 33R, 33B under identical electric field is about 7:2:1. Theoretically and ideally, if the distance between the electron-emission source layer 43 and the green, red and blue anode units 33G, 33R, 33R sets to 7:2:1, such that the distinct electric field strength ratio for the couples of anode and cathode units for green, red and red colors under identical voltage between anode and cathode can be adjusted to a ⅐:½:1, that is, 2:7:14. (According to the relationship E=V/D, where E is electric field strength, D is distance and V is potential) Thereby, the luminescent efficiencies ratio for the green, red and blue colors will become 1:1:1. As a result, colors of the phosphor layer 33, and a uniform brightness of the sub-pixels with primary color is achieved. The difference in luminescent efficiencies is thus compensated. Stronger electric fields are driven for the colors such as blue and red having lower luminescent efficiencies, the brightness of the blue and red colors is thus enhanced. In reality, however, the above-mentioned distance ratio can not be realized by currently available technology due to the very short distance between anode plate 30 and cathode plate 40. So an alternative way must be found out.

According to the result of experiments the inventors made, the luminescent efficiency ratio for the sub-pixels can approach to 1:1:1 by adjusting the distance ratio between the gate layer 45 and the green, red and blue cathode unit 43G, 43R, 43B to about 2:1:1 for green, red and blue colors. A preferred embodiment is shown in FIG. 2. The gate layer 45 is a uniform plane and the thickness of the cathode conductive units 42G, 42R, 42B aligned with different colored anode units 33G, 33R, 33B are different. By this, an almost perfect brightness compensation of sub-pixels with primary color can be reached under the condition of limited distance between anode plate 30 and cathode plate 40.

In the embodiment as shown in FIG. 2, the levels of the cathode unit 43G, 43R, 43B are adjusted by forming the cathode conductive units 42G, 42R, 42B with various heights or thickness. The method for fabricating the cathode conductive layer 42 with various thicknesses can be achieved by various processes.

For example, the thick-film process can be applied. By screen-printing multiple layers of silver paste, the cathode conductive layer 42 can be formed with a thickness determined by the number of layers of the silver paste.

Another example for forming the cathode conductive layer 42 includes photolithography process. A photosensitive silver paste is used as the material for forming the cathode conductive layer 42. By performing exposure on the silver paste with different exposure time, the height or thickness of the resulting cathode conductive layer 42 can be adjusted.

By either the thick-film process or photolithography process, the thickness or height of the cathode conductive layer can be precisely controlled. Therefore, the complex control circuit or complex process is not required. The brightness compensation can be achieved with the least cost.

While the present invention has been particularly shown and described with reference to preferred embodiments thereof, it will be understood by those of ordinary skill in the art the various changes in form and details may be made therein without departing from the spirit and scope of the present invention as defined by the appended claims.

What is claimed is:

1. A luminescent brightness compensating structure of a field-emission device, comprising:

an anode plate having a phosphor layer composed of a plurality of green, red and blue anode units;

a cathode plate comprising a cathode substrate;

a cathode conductive layer composed of a plurality of cathode conductive units and formed on the cathode substrate; and an electron-emission layer composed of a plurality of cathode units, each the cathode unit being formed on the cathode conductive unit, and each the cathode unit aligning with one of the anode units; and a gate layer apart disposed between the anode plate and the cathode plate;

wherein a perpendicular distance ratio of the green, red and blue cathode units to the gate layer is about 2:1:1.

2. The structure of claim 1, wherein the cathode conductive units on which the cathode units is formed aligned with the green, red and blue anode units are different in thickness.

3. A method for compensating luminescent brightness of a field-emission device, the field-emission device comprising:

an anode plate having a phosphor layer composed of a plurality of green, red and blue anode units;

a cathode plate comprising:

a cathode substrate;

a cathode conductive layer composed of a plurality of cathode conductive units and formed on the cathode substrate; and an electron-emission layer composed of a plurality of cathode units, each the cathode unit being formed on the cathode conductive unit, and each the cathode unit aligning with one of the anode units; and a gate layer apart disposed between the anode plate and the cathode plate;

the method comprising:

adjusting the perpendicular distance between the gate layer and the cathode unit according to the luminescent efficiency of the differently colored anode units aligned with the cathode unit.

4. The method of claim 3, wherein the adjusting step is to change thickness of the cathode conductive unit.

5. The method of claim 4, wherein the perpendicular distance ratio of the green, red and blue anode units to the gate layer is about 2:1:1.

6. The method of claim 3, wherein the perpendicular distance ratio of the green, red and blue anode units to the gate layer is about 2:1:1.

* * * * *